United States Patent [19]

Zelle

[11] 4,168,660

[45] Sep. 25, 1979

[54] SUGAR MILL

[75] Inventor: Alexander S. Zelle, Fairfield, Conn.

[73] Assignee: USM Corporation, Farmington, Conn.

[21] Appl. No.: 843,578

[22] Filed: Oct. 19, 1977

[51] Int. Cl.[2] ..... B30B 3/04; B30B 9/20

[52] U.S. Cl. ..... 100/45; 100/162 R; 100/168; 222/56

[58] Field of Search ..... 100/162 R–174, 100/75, 45, 47, 158, 289; 241/159, 34; 222/56, 200

[56] References Cited

U.S. PATENT DOCUMENTS

| | | | |
|---|---|---|---|
| 304,012 | 8/1884 | Leblanc | 100/75 |
| 308,049 | 11/1884 | Barreiras | 100/168 X |
| 1,570,795 | 1/1926 | Tainton | 222/200 X |
| 2,602,381 | 7/1952 | Ewaldson | 100/171 |
| 2,674,396 | 4/1954 | Peterson | 100/45 X |
| 4,015,919 | 4/1977 | Pawelczyk | 100/168 X |

FOREIGN PATENT DOCUMENTS

| | | | |
|---|---|---|---|
| 21848 | of 1905 | United Kingdom | 100/162 R |

*Primary Examiner*—Peter Feldman

*Attorney, Agent, or Firm*—Donald N. Halgren; Richard B. Megley; Vincent A. White

[57] ABSTRACT

A sugar mill utilizing an arrangement of rolls journalled between a pair of frame members, having a driven anvil roll as the lowermost roll. An adjustment cane roll is disposed between the frame members above the anvil roll. Intermediate and to one side of the cane and anvil rolls is a crusher/feed roll, and to the other side of the cane and anvil rolls there is a bagasse roll. The three uppermost rolls are adjustable with respect to one another, the side rolls may each be mounted in an eccentric or screw adjustable bearing support arrangement. A generally vertically disposed chute drops chopped sugar cane between the feed and cane rolls to permit gravity to aid in feeding of the chopped cane to the sugar mill. This arrangement of the rolls permits a higher sugar mill output per revolution of the rolls, than that of the prior art.

10 Claims, 3 Drawing Figures

10
12
13
14
15
16
17
18
19
20
21
22
24
26
30
32
34
36
38
42
44
50
60
62
64
66
70
72
80
82
84
86
88
100
102
103
104
106
110
112
120
124
130
132
133
134
136
150
II

SUGAR MILL

BACKGROUND OF THE INVENTION

1. Field of the Invention

This invention relates to sugar mills and more particularly to an adjustable four roll sugar mill for conveying and crushing chopped sugar cane to extract sucrose therefrom.

2. Prior Art

The production of sugar begins with the growing of sugar cane stalks in tropical or subtropical areas. The cane is harvested after a growing season of about seven months in the subtropics and after a growing season of about 12 to 22 months in the tropics. The cane stalks are harvested from the fields and transported to sugar mills nearby. The cane stalks are crushed or macerated between heavy grooved iron rolls while concurrently being sprayed with dilute juice to help extract the residual juice. Bagasse is the residue from the cane stalk after the juice has been extracted. The bagasse, is a fibrous substance which leaves the mill generally in the form of pressed mat. The bagasse is usually burned in boilers to provide energy for the sugar mill. It may also be used in the manufacture of paper and pressed boards.

The sucrose may be extracted in a series of mills. The mills are serially arranged so that the bagasse of one mill is conveyed immediately and continuously to the feed hopper of an adjacent mill. The space setting between the rolls on successive mills is reduced to extract the diminishing quantities of juice from the cane as it is passed therealong.

U.S. Pat. No. 2,783,870 shows how the mills are usually set up. In that patent, which is assigned to the assignee of the present invention, there is shown two roll stands, each consisting of three rolls: a top roll, a lower level cane or feed roll and bagasse roll. Between each mill unit is a conveyor belt arrangement. Each mill unit has a turnplate supported by a turn beam, mounted immediately beneath the top roll. This "T"-shaped member, for example, is shown in FIG. 1 of U.S. Pat. No. 3,127,831. The turnplate provides a stationary curvilinear surface over which the mat of crushed cane leaving the cane roll nip is supported and guided for passage to the nip of the bagasse roll. The rolls in a mill have "V"-shaped grooves which provide the nip which presses the cane therebetween. The rolls, in the prior art, also have chevron grooves which run generally longitudinally thereacross. The chevron grooves act as "gripping fingers" to pull the cane from the sloping supply chute into the pressure nip between the rolls. The chevron grooves reduce the amount of working surface of the rolls, thereby reducing the efficiency of the mill. Chevron grooves are shown, for example, in U.S. Pat. No. 2,442,065.

The gap between adjacent rolls needs to be adjusted from time to time because of a large mass of bagasse entering between the rolls, which must be accommodated, or because of wear on the rolls which must be compensated. One solution to this problem is shown in U.S. Pat. No. 2,316,843 where the top and bagasse rolls both pivot about a common juncture to permit adjustment in the gap between the top and feed rolls. This, however, is a complicated arrangement which does not permit a similar adjustment between the top and bagasse rolls.

Prior art mills have the anvil rolls uppermost on their frames, which location necessitated an ability to "float", because of variations in the cane volume used in the process. This required elaborate couplings because the anvil roll is generally the driven roll. The present invention places the driven anvil roll at the lowermost position without any need for adjustment or "floating" capabilities.

It is an object of the present invention to simplify the construction of sugar mill rolls.

It is a further object of the present invention to improve the efficiency of sugar mill rolls over that of the prior art.

BRIEF SUMMARY OF THE INVENTION

The present invention comprises a sugar cane mill having an arrangement of four processing rolls, wherein chopped sugar cane is conveyed to the mill and is dropped into a generally vertically oriented feed hopper. The chopped cane then falls into the nip between a first pair of rolls, the uppermost roll, being the cane roll, and a side roll, being the feed roll. The cane is given its first crushing and then is passed between the uppermost cane roll and another roll which is the lowermost or anvil roll. This provides a second crushing to the cane which is then passed between the anvil roll and a second side roll or bagasse roll for a third crushing. The crushed cane, which is now called bagasse, is dropped to a conveyor which takes it to a successive mill for a subsequent vertical drop, into another mill. The vertical feed hopper or chute allows gravity to aid in helping the chopped cane pass between the cane and feed rolls. This permits the elimination of the chevron grooves which are common in prior art rolls. The elimination of the chevron grooves permits more roll contact with the cane for each revolution of each roll, causing a substantial increase in mill efficiency. This arrangement of four rolls in one mill permits the elimination of the turnbeam and turnplate members of the mill. The arrangement of the anvil roll at the bottom of the mill and consequent rotational driving thereof at a fixed position eliminates the need for elaborate couplings which were necessitated in the prior art mills.

The rolls of the present invention may be individually adjusted by movement of micro-adjustable screw arrangements, on each end thereof. Pressure is supplied to the rolls by a hydraulic piston arrangement on the ends of each roll, or by a biasing member which is manually controlled. The side rolls may be adjusted further to change the gap between rolls or to compensate for roll wear, by being journalled in adjustable eccentric supports.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 1:
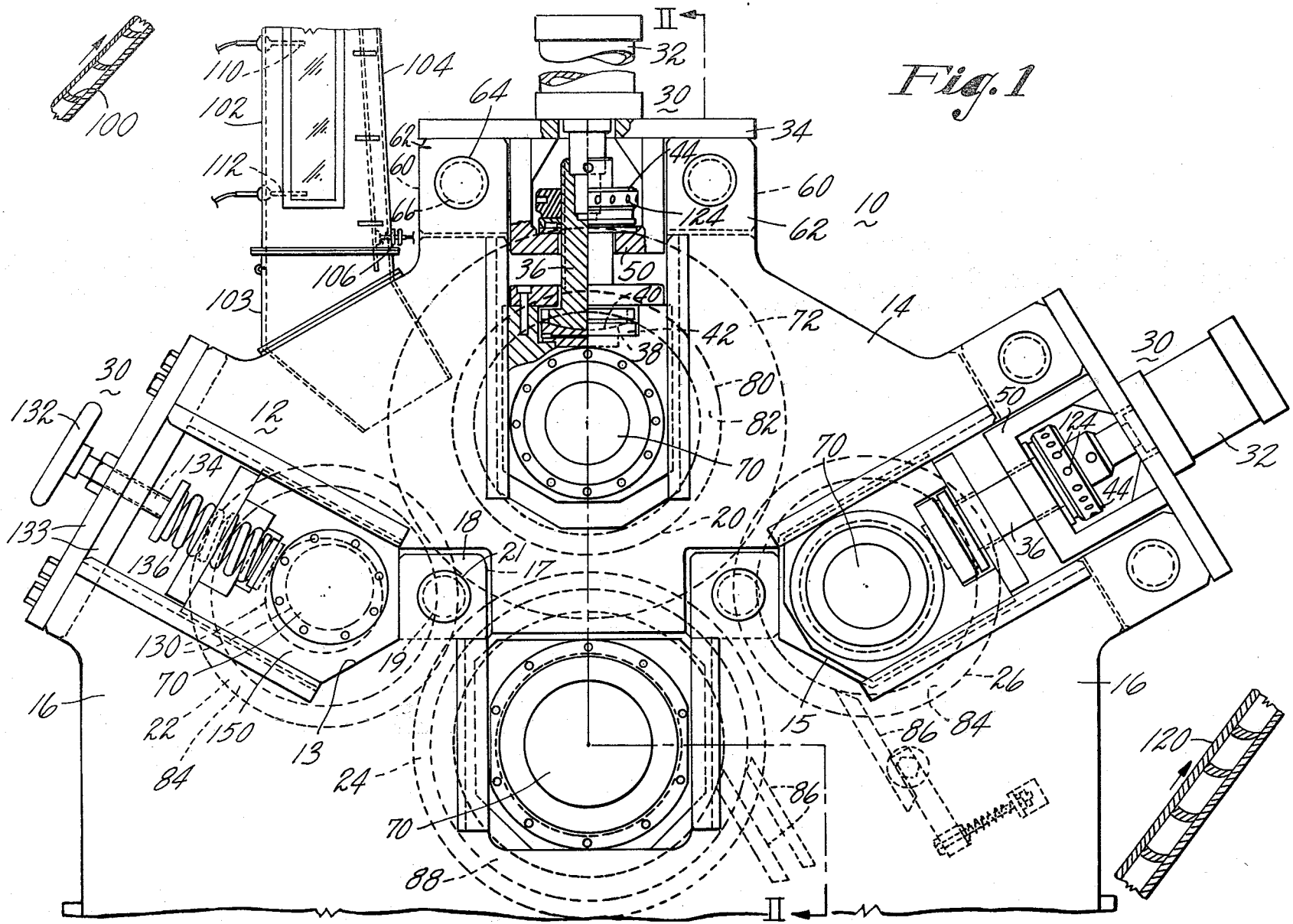
FIG. 1 is a side elevational view of a sugar mill with portions removed to further illustrate the machine.

Referring now to the drawings, and particularly to FIG. 1, there is shown a sugar cane mill 10. It is to be noted at the outset, that the mill 10 could be used to process sugar beets or the like, and not just sugar cane. The mill 10 consists of a pair of generally parallel frames 12, only one being shown. The frame 12 includes an upper frame portion 14 and a lower frame portion 16. The frames 12 have an arrangement of rolls journalled between them. The rolls include an uppermost, or cane roll 20 rotatively disposed in the upper frame portions 14; a first side roll or feed roll 22, shown on the left in FIG. 1, supportively disposed in a receiving slot 13 or recess, between the upper frame portion 14 and the lower frame portion 16; a lowermost roll or anvil roll 24, rotatively empowered by a prime mover, not shown, the anvil roll 24 being disposed in the lower frame portion 16 and a second side roll or bagasse roll 26, shown on the right in FIG. 1, being supportively disposed in a receiving slot 15 between the upper frame portion 14 and the lower frame portion 16. The upper frame portion 14 and the lower frame portion 16 having an arrangement of interdigitated lugs 17 and 18 each having a coaxial bore 19 extending therethrough. A pin 21 is disposed through the bore 19 to lock the upper and lower frame members 14 and 16 together.

Each of the three uppermost rolls have a biasing arrangement 30 disposed at each end thereof, only one end being shown in the drawings. In FIG. 1, a similar biasing arrangement 30 is shown for the cane roll 20 and the bagasse roll 26. This particular biasing arrangement 30 is supported in a top cap 34. The top cap 34 has a pair of depending lugs 60, one on each side thereof. The upper frame portion 14 has a dual arrangement of upstanding lugs 62 which receive the depending lugs 60 of the top cap 34, therebetween. The top cap 34 is secured to the frame 12 by a pin 64 which extends through a coaxial bore 66 in each of the lugs 60 and 62.

The biasing arrangement 30 for the cane roll 20 includes a hydraulic piston and cylinder 32 activatably disposed against a displaceable micro-adjustable screw shaft 36. The radially inner end of the screw shaft 36 has a convex shaped surface 38 which slidingly mates with a concave surface 40 in a bearing plate 42. The bearing plate 42 is part of a bearing housing 43 disposed about a bearing 45. A ring 47 is disposed about a shoulder 49 on the lower end of the screw shaft 36. The ring 47 being secured to the bearing housing 43, to cause a vertical movement in the journal 70 corresponding to any vertical movement of the screw shaft 36. The upper end of each screw shaft 36 has an adjustable nut 44 disposed thereabout. A thrust bearing 48 is disposed about the screw shaft 36, between the adjustable nut 44 and an annular shoulder 50, which comprises a portion of the top cap 34. The biasing arrangements 30 each may act upon a journal 70 of their respective rolls, as is partially shown in FIG. 2.

Figure 2:
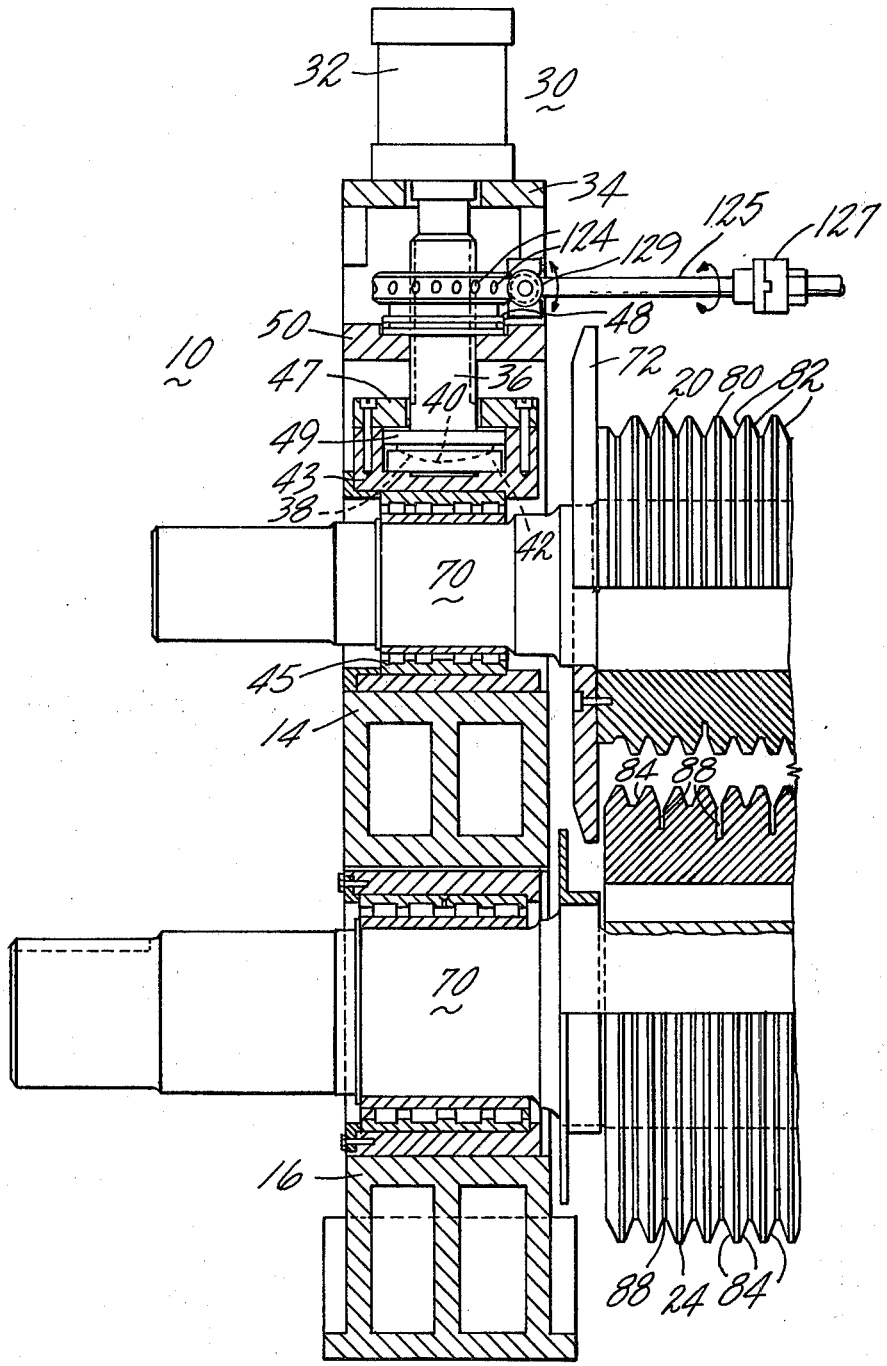
FIG. 2 is a view taken along the lines II—II of FIG. 1.

The cane roll 20 has a side roll juice ring 72 disposed one on each end thereof, each just inside the frame 12 of the mill 10. The cane roll 20 has a working surface 80 which is comprised of a plurality of "V"-shaped grooves 82. The feed roll 22 and the bagasse roll 26 as well as the anvil roll 24, also have a plurality of "V"-shaped grooves 84 thereon. The anvil roll 24 is the only roll to have a plurality of drainage grooves 88 disposed thereabout, as shown in FIGS. 1 and 2. The drainage grooves 88 are narrow, deep grooves, which help passage of juice from the crushed sugar cane instead of permitting it to be reabsorbed by the cane. The rolls each have an arrangement of "scraper knives" 86, to remove any stuck cane from the revolving grooves 84 and 86. The drainage grooves are eliminated from the cane roll 20 and the side rolls 22 and 26 because the course the crushed cane follows in the present invention is different from the "U"-shaped course of the prior art.

Utilization of the mill 10 begins when the chopped cane is introduced to the mill 10 from a conveyor belt 100, as partially shown in the upper left-hand corner of FIG. 1. The conveyor belt 100 feeds the cane into a vertical feed hopper or chute 102. The vertical hopper 102 has a generally planar wall 104 which is hinged at its upper end near the top of the vertical hopper 102. A biased pressurizable cylinder 106 or reciprocatable device is disposed between the vertical hopper 102 and the hinged wall 104. When the cylinder 106 is activated, it will oscillate the hinged wall back and forth to unloosen any chokeup of cane occurring within the feed hopper 102. The feed hopper 102 also has a hinged door 103 near its base, permitting inspection and cleaning of the mill 10 and feed hopper 102 as necessary. The feed hopper 102 has an upper lever sensor 110 and a lower level sensor 112, in one of its walls to detect any backup or depletion of cane that it introduced into the mill 10. Activation of either sensor 110 or 112, will cause a signal to be fed back through a proper circuit, not shown, to speed governing controls on the conveyor belt 100 to slow it down or speed it up, as necessary for optimum flow.

Once the chopped cane has entered the vertical hopper 102, it is caused to drop into the crushing nip directly between the counterclockwise rotating cane roll 20 and the clockwise rotating feed roll 22. The drop of the cane by gravity into the nip of the cane and feed rolls 20 and 22, eliminates the requirement for the chevron grooves of the prior art, which were necessary to "pull" the cane into the nip between the rolls. Elimination of the chevron grooves, which used up much of the working surface of the rolls, now permits a more efficient mill, and a higher output of crushed cane, bagasse, and hence, sucrose, per revolution of roll. As the cane progresses in the mill 10, it is caused to next pass between the cane roll 20 and the anvil roll 24, for further crushing and sucrose extraction.

In the present invention, the anvil roll 24 does not float, permitting adaption with a simpler coupling with the motive empowerment, not shown.

After passing between the cane roll 20 and the anvil roll 24, the crushed cane is directed to the nip between the bagasse roll 26 and the anvil roll 24, for final crushing and sucrose extraction in this particular mill 10. The pulp or bagasse residue is ejected to another conveyor belt 120, partially shown on the lower right side of FIG. 1, for transmittal to a subsequent mill for further processing or to a boiler for burning.

If the bagasse is to be processed further, the latter conveyor belt 120 would take the residue to a vertical hopper in a subsequent mill similar to the aforementioned. The crushing nips of the subsequent mills would be narrower. That is, the distance between the subsequent cane roll 20 and the feed roll 24; the cane roll 20 and anvil roll 26, and anvil roll 24 and bagasse roll 26 would each be smaller, because of the diminishing sucrose content of the bagasse during its subsequent processing. The distance between roll surfaces is adjustable by turning the adjustable nut 44 accordingly, on the respective screw shafts 36. Rotation of the nut 44 causes vertical movement of the screwshaft 36 and its associated bearing plate 42, causing corresponding movement in the bearing housing 43 and bearing 45 disposed about the journal 70. Appropriate rotation of the nut 44 causes an upward movement of the roll and its associated journal because the ring 47 is secured to the bearing housing 43 and is in overlapping contact with the lower rim 49 of the screw shaft 36. Each adjustable nut 44 may be manually rotated. The adjustable nut 44 has a plurality of bores 124 on its circumference in which an elongated hand-tool may be inserted therein for manual rotation of the nut 44. The adjustable nut 44 could be turned by a motorized gear, or the like, for the convenience of remote control. A rotatively journalled shaft 125, may be mounted, with a clutchable linkage 127 and a gear 129 engageable with each adjustable nut 44, to permit the simultaneous corresponding adjustment thereof.

The biasing arrangement 30 alternatively may include a spring loaded eccentric 130, as shown with the feed roll 22 in FIG. 1. The spring loaded eccentric 130 comprises a rotatable handwheel 132 secured to the outer end of a threaded shaft 134. The threaded shaft 134 extends through a threaded bore in a pair of plates 133 which are secured to the frame 12. The inner end of the threaded shaft 134 is in rotative contact with the upper end of a spring member 136. The lower end of the spring member is in rotative contact with a bearing housing 150 disposed about the journal 70 of the roll 22. Rotation of the handwheel 132, displaces the radially outer end of the spring member 136, and causes a proper bias to be transmitted to the journal 70, to permit the cane roll 22 to effect an adjustable "floating" force on the cane as it passes between it and the cane or anvil roll 20 and 24.

The journal 70 of the feed roll 22, in this embodiment, is eccentrically mounted in a rotatable bearing housing 150, as shown in FIG. 1. The bearing housing 150 is supported in the recess 13 between the upper frame portion 14 and the lower frame portion 16. As the bearing housing 150 is rotated, the journal 70 of the eccentrically mounted feed roll 22 disposed therein moves in an elliptical path toward or away from the axis of the anvil roll 24 and the cane roll 20. This eccentric mounting of the journal 70 in the bearing housing 150 permits translational adjustment of the feed roll 22, periodically necessitated because of the roll wear, or because it is necessary to change the distance between one or two adjacent rolls for effective cane crushing.

Figure 3:
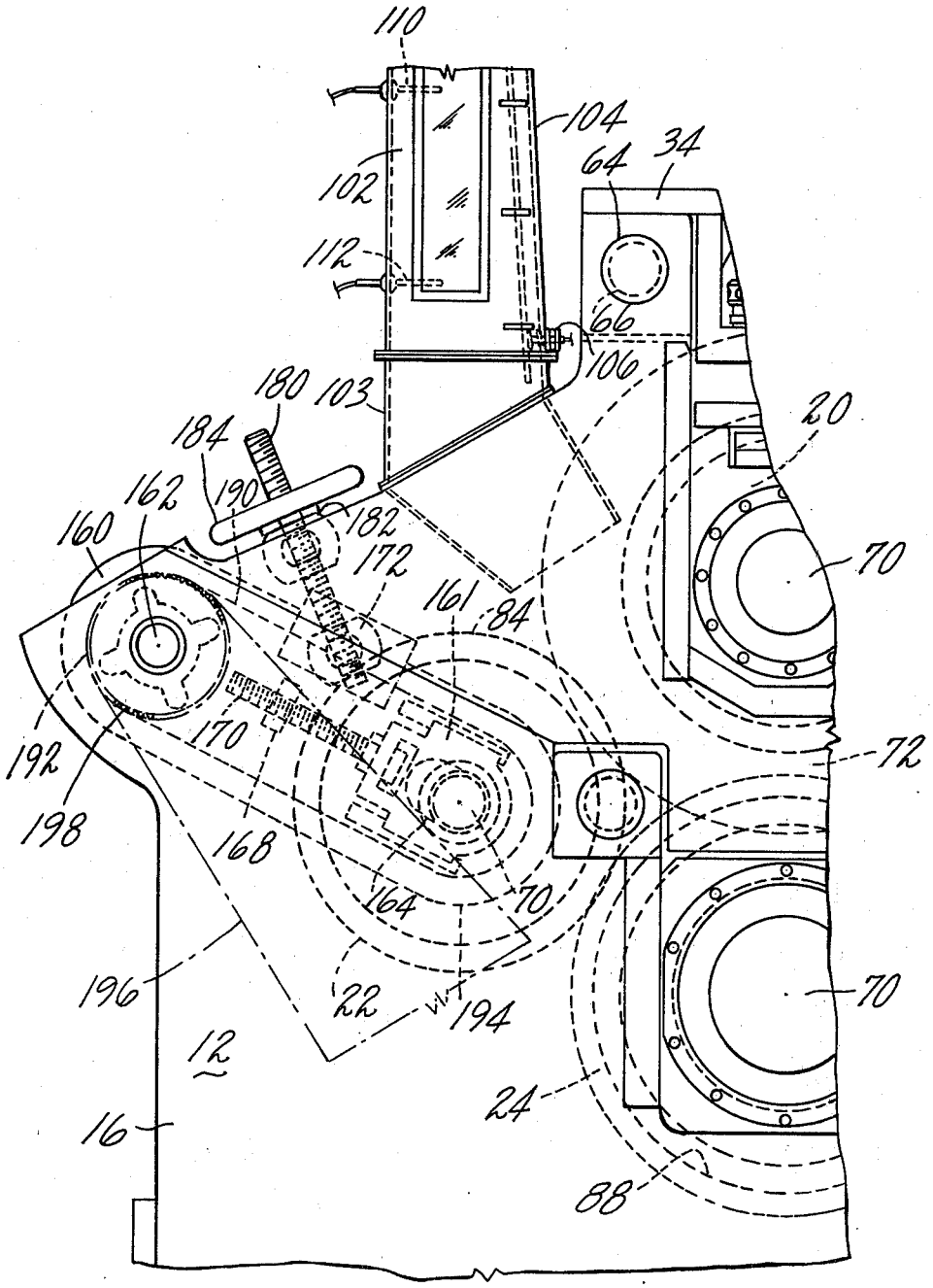
FIG. 3 is a view of an alternate support and adjustment mechanism for the side rolls of the mill.

An additional arrangement for supporting the feed roll 22, is shown in FIG. 3, wherein a pair of elongated frames 160, only one shown, pivot at one end about a first axis 162 journalled between the frames 12 of the mill 10. The other end of the elongated frame 160 supports the journal 70 of the feed roll 22, in a bearing housing 161. The bearing housing 161 supporting the journal 70 of the feed roll 22 is arranged to permit adjustable movement of the bearing housing 161 in an elongated slot 164 in the elongated frame 160. A nut 168 is secured to the elongated frame 160 and supports a rotatable threaded shaft 170. The other end of the shaft 170 is rotatively secured to the bearing housing 161. By rotation of the threaded shaft 170, the feed roll 22 is moved laterally toward or away from the other rolls and longitudinally with respect to the elongated frame 160.

A second nut 172 is pivotally secured to a mid-point of the elongated frame 160. The second nut 172 receives one end of a second rotatable threaded shaft 180. The other end of the second threaded shaft extends through a threaded hub 182 which is pivotally secured to the frame 12 of the mill 10. A handle 184 is rotatively secured at the top end of the second threaded shaft 180 to the threaded hub 182. When the handle 184 is turned, it causes the second threaded shaft to rotate in the second nut 172 and the threaded hub to cause an upward or downward arcuate movement of the feed roll 22 about the first axis 162 of the elongated frame 160. By turning the threaded shafts 170 and 180, the feed roll 22 may be adjusted in its relationship with respect to the cane roll 20, or the anvil roll 24, or both of them. The feed roll 22 is caused to rotate, in this embodiment, by a chain 190 which is disposed about a sprocket 192 on the first axis 162 and a second sprocket 194 disposed about the journal 70 of the feed roll 22. A second chain 196, for example, or other drive means, is attached to yet another sprocket 198 disposed on the first axis 162 outside of the frame member 12 and is disposed about a gear arrangement, not shown, for the prime mover, also not shown, to provide the empowerment for rotating the rolls, only the feed roll being described in this embodiment. The other rolls may be similarly driven.

There has been shown a unique sugar mill utilizing a novel arrangement of adjustable roll members between a pair of frame supports, which roll arrangement permits the elimination of expensive components standard in the prior art, while increasing the sucrose output of the rolls per revolution.

I claim:

1. A sugar mill for the extraction of cane juice from cane, said sugar mill comprising:

a pair of generally parallel frame members;

at least four rolls journalled between said frame members for crushing said cane, including: an uppermost cane roll disposed between corresponding top portions of said frame members and a lowermost anvil roll disposed generally beneath said cane roll providing a nip therebetween;

a feed roll disposed on one side of and parallel to said nip between said cane and anvil rolls;

a bagasse roll disposed on one side of and parallel to said nip between said cane and anvil rolls;

the three uppermost rolls being adjustable with respect to the distance between one another and to said lowermost anvil roll;

at least one of said rolls disposed on the side of said cane and anvil rolls is supported between said frame members for adjustment relative to others of said rolls;

said one roll being journalled in one end of an adjustable frame;

said adjustable frame being pivoted at the other end between said frame members of said mill; and said adjustable frame having at least two adjusting mechanisms, one adjusting mechanism permitting controlled lateral movement of said roll lengthwise along said adjustable frame, the second adjusting mechanism arranged between said adjustable frame and said frame of the mill, to effectuate arcuate movement of said roll therewith.

2. A sugar mill for the extraction of cane juice from cane as recited in claim 1, wherein at least one of said rolls journalled between said frame members is mounted in an arrangement of eccentric adjustable bearing housings permitting said roll to be laterally displaced toward or away from any of the other of said rolls.

3. A sugar mill for the extraction of cane juice from the cane as recited in claim 1, wherein at least one of said rolls has bearings journalled at each end in a bearing housing, and said roll is laterally displaceable by utilization of an adjustment means connected to each bearing housing, each of said adjustment means comprising a threaded shaft having a rotatable nut therearound, said threaded shaft acting between said frame and said bearing housing as said nut is rotated, to produce a movement in said bearing housings.

4. A sugar mill for the extraction of cane juice as recited in claim 3, wherein said adjustment means on said rolls includes a shaft rotatably engaged between said adjustment means to permit simultaneous corresponding movement of both means, upon rotation of one of said adjustment means.

5. A sugar mill for the extraction of cane juice, as recited in claim 1, including:

a feed hopper generally vertically disposed on said frame members to permit said cane to be dropped therethrough and into the nip between two of said rolls, said vertical drop of said cane into said nip between said rolls aiding in the receiving of cane therebetween, permitting a higher cane crushing efficiency of said cylindrically shaped rolls for each revolution thereof.

6. A sugar mill for the extraction of cane juice from cane as recited in claim 5, wherein said generally vertically oriented feed hopper comprises a chute having at least one wall which is hinged at its top to the feed hopper, said hinged wall having a pressurizable cylinder at its lower end which upon activation of said pressurizable cylinder will oscillate the hinged wall to eliminate any blockage of said hopper by any cane stuck therewithin.

7. A sugar mill for the extraction of cane juice from cane as recited in claim 5 wherein said sugar mill has at least one conveyor arrangement to feed chopped cane to the top of said hopper;

said hopper also comprises a sensor which detects when the level of cane in said hopper is at a low level and said sensor thereupon activates a mechanism to increase accordingly, the speed of said conveyor belt that is feeding said hopper.

8. A sugar mill for the extraction of cane juice from cane as recited in claim 5, wherein said sugar mill has at least one conveyor arrangement to feed chopped cane to the top of said hopper;

said hopper also comprises a sensor which detects when the level of cane in said hopper is at an upper level, and said sensor thereupon activates a mechanism to decrease accordingly the speed of said conveyor belt that is feeding said hopper.

9. A sugar mill for the extraction of cane juice from cane as recited in claim 5, wherein each of said frame members is comprised of an upper frame member and a lower frame member.

10. A sugar mill for the extraction of cane juice from cane as recited in claim 9, wherein said feed roll and said bagasse roll each having a bearing housing on each end thereof disposed in a receiving slot arranged between said upper frame member and said lower frame member.

* * * * *